US005885473A

United States Patent [19]

Ando et al.

[11] Patent Number: 5,885,473

[45] Date of Patent: Mar. 23, 1999

[54] LONG NOZZLE FOR CONTINUOUS CASTING

[75] Inventors: Mitsuru Ando; Shigeaki Takahashi, both of Gifu-ken, Japan; Andy Elksnitis, Burlington, Canada

[73] Assignee: Akechi Ceramics Kabushiki Kaisha, Japan

[21] Appl. No.: 857,537

[22] Filed: May 16, 1997

[30] Foreign Application Priority Data

May 17, 1996 [JP] Japan ..... 8-147958

[51] Int. Cl.[6] ..... B22D 37/00

[52] U.S. Cl. ..... 222/590; 222/603; 222/606

[58] Field of Search ..... 222/590, 603, 222/606, 607, 571

[56] References Cited

U.S. PATENT DOCUMENTS

| | | | |
|---|---|---|---|
| 4,531,567 | 7/1985 | Gruner et al. | 222/603 |
| 4,555,050 | 11/1985 | Schiefer et al. | 222/606 |
| 4,583,721 | 4/1986 | Arakawa et al. | 222/603 |
| 4,854,487 | 8/1989 | Ando et al. | 222/606 |
| 4,949,885 | 8/1990 | Struble et al. | 222/603 |

FOREIGN PATENT DOCUMENTS

| | | | |
|---|---|---|---|
| 0104454 | 4/1990 | Japan | 222/603 |

*Primary Examiner*—Scott Kastler
*Attorney, Agent, or Firm*—Thorp Reed & Armstrong

[57] ABSTRACT

The present invention relates to a long nozzle used to prevent molten steel flowing out of a collector nozzle of a sliding nozzle from being oxidized by atmospheric air when molten metal, particularly molten steel is poured from a ladle into a tundish. This nozzle has a construction comprising: (a) the long nozzle (3) made of a refractory causes molten metal to flow down from the collector nozzle (2) and the head thereof is covered by a metallic shell (16); (b) a first gas passage is provided to blow inert gas to the vicinity of a fitting portion (7) between the collector nozzle (2) and the long nozzle (3) through a first gas inlet port (8) provided on the side wall of the metallic shell (16); and (c) a second gas passage is provided to blow inert gas into an inner hole (18) of the long nozzle through a second gas inlet port (10) provided on the side wall of the metallic shell (16).

18 Claims, 3 Drawing Sheets

LONG NOZZLE FOR CONTINUOUS CASTING

FIELD OF THE INVENTION

The present invention relates to a long nozzle used for pouring molten metal, such as molten steel. The molten metal flows out of a collector nozzle of a sliding nozzle, which is used for controlling flow rate and is provided at the bottom of a ladle into a tundish for the continuous casting of molten metal. Additionally, oxidation caused by the atmosphere contacting the molten metal, particularly molten steel, is prevented when the molten metal is poured from a ladle into a tundish.

BACKGROUND AND DESCRIPTION OF THE RELATED ART

A sliding gate, which is attached to the bottom of the ladle is used to control the flow rate of molten steel flow when molten metal, particularly molten steel, is poured from a ladle into a tundish in the continuous casting of steel.

FIG. 5 shows a sliding gate 200 attached to the bottom of a ladle 100. A so-called collector nozzle 2 is disposed on the lower side of this sliding nozzle 200. A long nozzle is a very important functional member used for preventing molten steel from being oxidized by atmospheric air and also for preventing molten steel from splashing when molten steel is poured from the collector nozzle 2 into a tundish (not shown).

When molten steel is poured from the ladle 100 into the tundish, molten steel flows down rapidly through a long nozzle inner hole. Through the dynamic pressure of this molten steel, the pressure in the inner hole becomes negative with respect to the outside atmospheric air. Due to this pressure difference, atmospheric air is sucked into the long nozzle inner hole through a fitting portion between the long nozzle and the collector nozzle. The sucked-in air oxidizes the molten steel flowing down through the long nozzle inner hole. As a result, qualities, such as cleanliness of the cast steel and the yield thereof, are remarkably lowered.

To solve the above problem, that is, to prevent molten metal from being oxidized by the air sucked through the fitting portion, methods have been carried out whereby 1) an inert gas such as argon gas or nitrogen gas is blown around the fitting portion or 2) a sealing material such as a refractory plastic material is used.

FIG. 6 shows an example of prior art, which was disclosed in Japanese Patent Laid-Open No. 1-100656 by the Applicant of this invention. A porous brick 50 is disposed at a fitting portion 7 between a head, which is reinforced by a metallic cover 16 of a long nozzle 3 and a collector nozzle 2. An inert gas is blown by passing through the porous brick 50 through an inert gas supply port 70, such that the air at the fitting portion and the upper and lower portions thereof is replaced with the inert gas. The pressure in the long nozzle inner hole is brought from a negative pressure to a pressure near the atmospheric pressure, by which the suction of air through the fitting portion is controlled and the sealing function is enhanced.

The above-conventional methods present various problems as described below, and results in a considerable problem in carrying out continuous casting stably and economically. In recent continuous casting, molten steel of 3 to 6 ladles has usually been cast continuously in one sequence cast, and further continuous-continuous casting (sequence continuous casting) of molten steel of 10 to 15 ladles has frequently been carried out.

In such continuous-continuous casting, the supply of molten steel from a first ladle to the tundish is carried out such that an allowable maximum amount of molten steel is supplied to the tundish. When the remaining molten steel in this ladle decreases, the first ladle is rapidly changed to a second ladle before the lower limit of tundish capacity is reached, and the supply of molten steel to the tundish is restarted.

Specifically, when the ladle is changed, the supply of molten steel to the tundish is finished, and after a sliding gate is closed, the collector nozzle of the sliding gate is separated from the long nozzle. As long as the long nozzle is sound even if the ladle is changed, the head of the long nozzle is cleaned to remove a sealing material or splashed steel around the head, and the collector nozzle of the next ladle is fitted to this long nozzle.

Before the collector nozzle of the next ladle is fitted to the long nozzle, a worker sometimes removes the remaining steel sticking to the fitting portion of the long nozzle through the use of an iron bar. Additionally, cleaning may also be performed by means of, for example, using oxygen gas to dissolve and remove the metal, which is sticking and solidifying to the lower part of the fitting portion. Through such repair work, the surface of the fitting portion 7 of the long nozzle gets rough. As the change frequency of the ladle increases, this phenomenon proceeds, and finally, any smoothness in the fitting portion is lost and the sealing function in fitting the long nozzle to the collector nozzle is impaired.

Thereupon, a limit to the use of the long nozzle itself is reached, and the quality and yield of the cast steel are lowered. The porous brick 50, which is integrally fixed to the long nozzle by means of a less permeable refractory mortar disposed at the fitting portion 7, is subjected to heat cycle of heating and cooling by the aforementioned work.

Therefore, various problems arise in that the head of the long nozzle is destroyed by thermal stress and physical stress, the blowing mode of inert gas is disturbed, and the sealing property is greatly impaired, such that the inflow of air into the long nozzle inner hole is allowed. These problems can be avoided to some degree, for example, by increasing the blowing amount of inert gas supplied to and around the fitting portion between the collector nozzle and the long nozzle through the porous brick. However, if the blowing amount of inert gas is increased too much, the inert gas blown into the long nozzle inner hole flows down directly into the tundish, resulting in a rampage of molten steel.

Consequently, slag and powder, which are a protective layer for the molten steel surface, are broken by the violent rampage of molten steel, such that the molten steel is exposed to the atmospheric air, or a large amount of molten steel is splashed. As a result, the quality of molten steel is degraded, or a safety problem arises. These problems cannot be overcome even when the blowing amount of inert gas is controlled.

SUMMARY OF THE INVENTION

The present invention was made to solve the above problems, and has a construction as described below.

A first embodiment of the invention provides a long nozzle for continuous casting, which is fitted to a collector nozzle having a sliding gate attached to the bottom of a ladle, in which:

(a) the long nozzle (3) made of a refractory causes molten metal to flow down from the collector nozzle, (2) and the head thereof is covered by a metallic shell (16);

(b) a first gas passage is provided to blow inert gas to the vicinity of a fitting portion (7) between the collector nozzle (2) and the long nozzle (3) through a first gas inlet port (8) provided on the side wall of the metallic shell (16); and (c) a second gas passage is provided to blow inert gas into an inner hole (18) of the long nozzle through a second gas inlet port (10) provided on the side wall of the metallic shell (16).

A second embodiment of the present invention provides a long nozzle for continuous casting, in which the first gas passage comprises a gas pool (34) provided between the metallic shell (16) and the side wall of long nozzle head, which connects to the first gas inlet port (8), and a slit (32) provided between the metallic shell (16) and the upper surface of long nozzle head, which connects to the gas pool (34).

A third embodiment of the present invention provides a long nozzle for continuous casting, in which the first gas passage comprises a gas pool (34) provided between the metallic shell (16) and the side wall of long nozzle head, which connects to the first gas inlet port (8), and a highly permeable porous brick (47) capable of blowing inert gas from the gas pool (34) to the vicinity of the fitting portion (7) between the long nozzle and the collector nozzle.

A fourth embodiment of the present invention provides a long nozzle for continuous casting, in which the second gas passage comprises a gas passage (42) connected to the second gas inlet port (10) provided on the side wall of long nozzle head, a gas pool (44) connected to the gas passage (42), and a gas blowing ring (45) provided with many small holes (46) for blowing gas from the gas pool (44) into the inner hole (18) of the long nozzle.

A fifth embodiment of the present invention provides a long nozzle for continuous casting, in which the second gas passage comprises a gas pool (43) connected to the second gas inlet port (10), and a ring-shaped porous brick (47) for blowing gas from the gas pool (43) into the inner hole (18) of the long nozzle.

DETAILED DESCRIPTION OF THE INVENTION

The present invention provides a long nozzle which, unlike the conventional long nozzle, comprises a first gas flow passage provided for supplying a large amount of inert gas to the fitting portion between a collector nozzle and the long nozzle prevents molten metal from being more completely oxidized, and a second gas flow passage provided for blowing a small amount of inert gas to compensate for a negative pressure produced in a long nozzle inner hole. This long nozzle, having such a construction, can better prevent the oxidation of molten metal than the conventional long nozzle.

Figure 1:
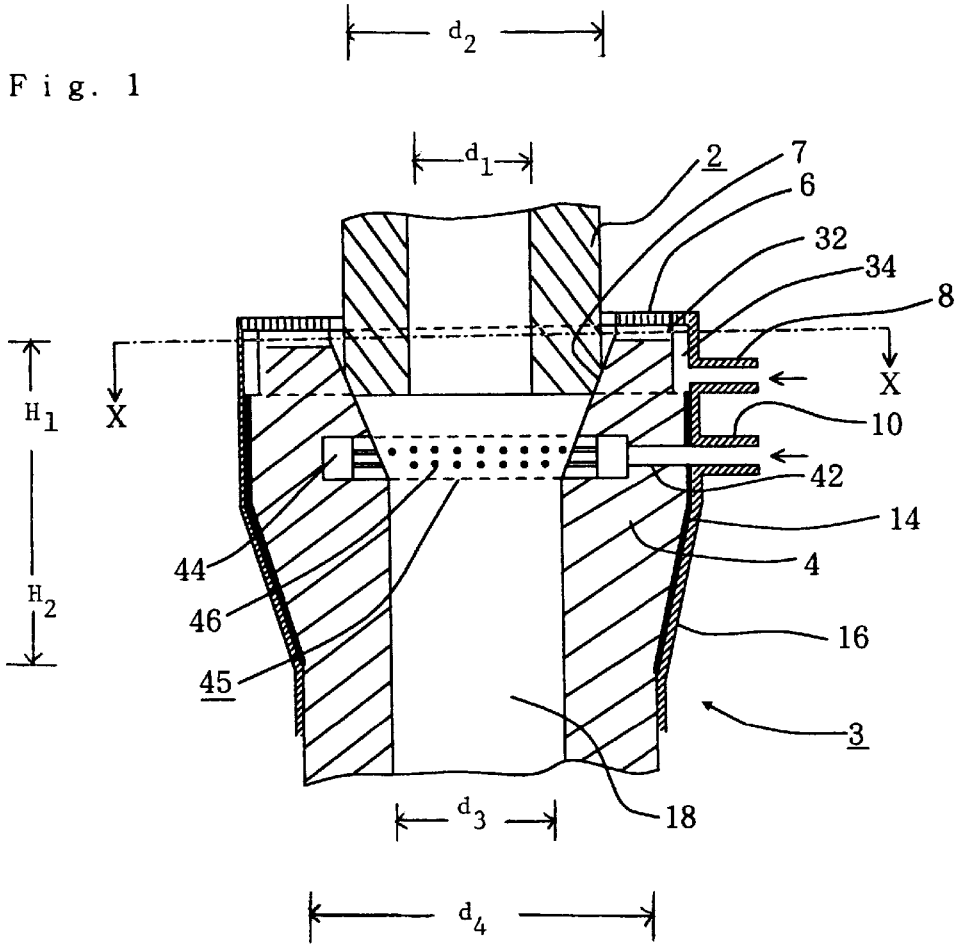
FIG. 1 shows a longitudinal cross section of one embodiment of the invented long nozzle.
Figure 2:
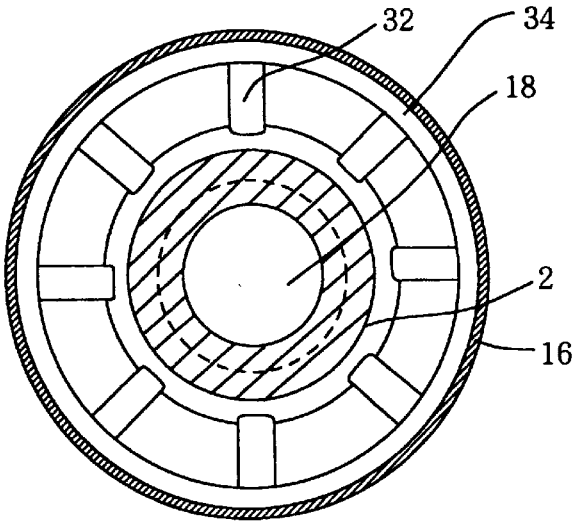
FIG. 2 shows a horizontal cross section cut along X—X plane of the above embodiment of the invented long nozzle.
Figure 3:
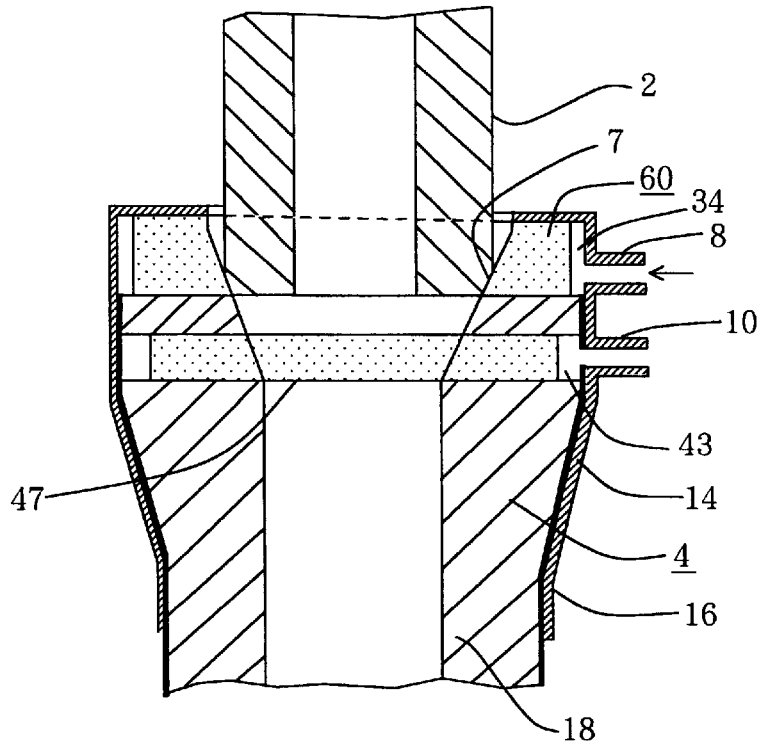
FIG. 3 shows a longitudinal cross section of another embodiment of the invented long nozzle.

The embodiments of the present invention are shown in FIGS. 1 to 3. In these embodiments, the long nozzle was manufactured as follows. A compound, which was produced by compounding an organic binder of 10% to an aggregate, which was composed of 26 wt % of graphite, 49 wt % of alumina, and 25 wt % of silica, was kneaded, and the raw material was formed by using a press, and fired at 1300° C.

The approximate dimensions of the manufactured long nozzle are as follows. The outside diameter (d4) is 170 mm, the inside diameter (d3) is 110 mm, the head (H1+H2) is 200 mm, and the total length is 700 mm. The outside diameter (d2) of the collector nozzle is 160 mm, and the inside diameter (di) thereof is 95 mm.

FIG. 1 is a longitudinal sectional view of the head of the long nozzle in accordance with one embodiment of the present invention. A long nozzle 3 is connected to a collector nozzle 2 at a socket-shaped fitting portion 7. An inert gas (hereinafter referred to simply as gas) is introduced through a first gas inlet port 8 into a gas pool 34, and blown to the upper part of the fitting portion through a slit 32 provided between a metallic shell 16 and the upper surface of the long nozzle head. The slit 32 is disposed radially at predetermined intervals on the long nozzle head surface as shown in FIG. 2, which is a sectional view taken along the line X—X of FIG. 1.

This slit 32 communicates with the gas pool 34 formed between the side surface of long nozzle head and the metallic shell. The gas pool 34 communicates with the first gas inlet port 8. Therefore, the gas introduced by pressure through the first gas inlet port 8 is sufficiently blown to the upper side of the fitting portion 7 between the collector nozzle and the long nozzle, such that the atmospheric air absorbed into an inner hole 18 through the fitting portion is shut off, whereby the oxidation of molten steel flowing down in the inner hole can be prevented.

The gas blown through the slit 32 seals the whole of the collector nozzle and the sliding gate, which prevents the absorption of atmospheric air caused by a negative pressure produced by the flowing-down of molten metal from a ladle nozzle to the collector nozzle.

As described above, the long nozzle, in accordance with the present invention, is provided with the first gas passage consisting of the gas pool 34, which is provided between the metallic shell 16 and the side wall of the long nozzle head, which connects to the first gas inlet port 8, and the slit 32 provided between the metallic shell 16 and the long nozzle head, which connects to the gas pool 34. Therefore, since the resistance to the flow of gas is small, a large amount of gas, for example, 100 to 500 l/min of gas can be blown to the fitting portion between the long nozzle and the collector nozzle, such that the absorption of atmospheric air into the nozzle inner hole through the fitting portion can be prevented.

In the present invention, a second gas passage is further provided. This gas passage comprises, for example, a gas inlet passage 42 provided in a refractory of the long nozzle, which is connected to a second gas inlet port 10 provided on the side wall of the long nozzle head, a gas pool 44 connected to the gas inlet passage 42, and a gas blowing ring 45 made of a refractory, which is provided with many small holes of about 1 mm in diameter for blowing the gas from the gas pool 44 into the inner hole of the long nozzle. This gas blowing ring 45 may be manufactured independently and then pushed into the long nozzle, or it may be manufactured integrally when the long nozzle body is manufactured.

The second gas passage is a passage for the gas blown to compensate for the negative pressure produced by the molten metal flowing down in the long nozzle inner hole. Therefore, the second gas passage may be a passage of a size sufficient to introduce a relatively small amount of gas unlike the first gas inlet port 8. The flow rate of gas passing through this passage is about 3 to 30 l/min. The portion between the first gas inlet port 8 and the second gas inlet port 10 is made airtight by means of mortar 14.

FIG. 3 shows another embodiment. In this embodiment, both of the first and second gas passages are formed by porous bricks 60 and 47, respectively. However, the porous brick 60, which forms the first gas passage has a higher permeability than the porous brick, which forms the second gas passage, to the extent that about tenfold gas can be blown. The porous brick 47 is made of, for example, 70 wt % alumina and the balance, comprising of silica.

Figure 4:
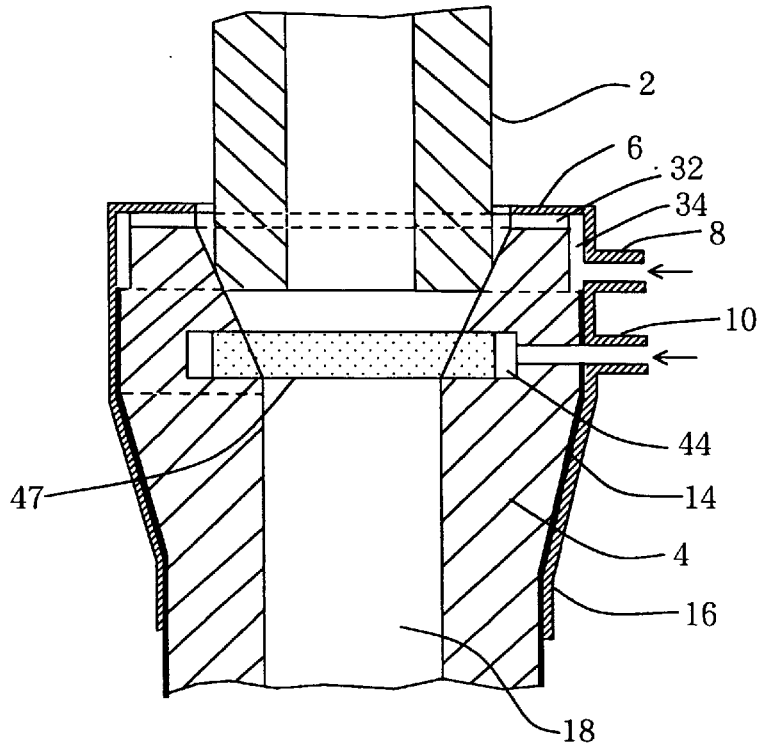
FIG. 4 shows a longitudinal cross section of another embodiment of the invented long nozzle.
Figure 5:
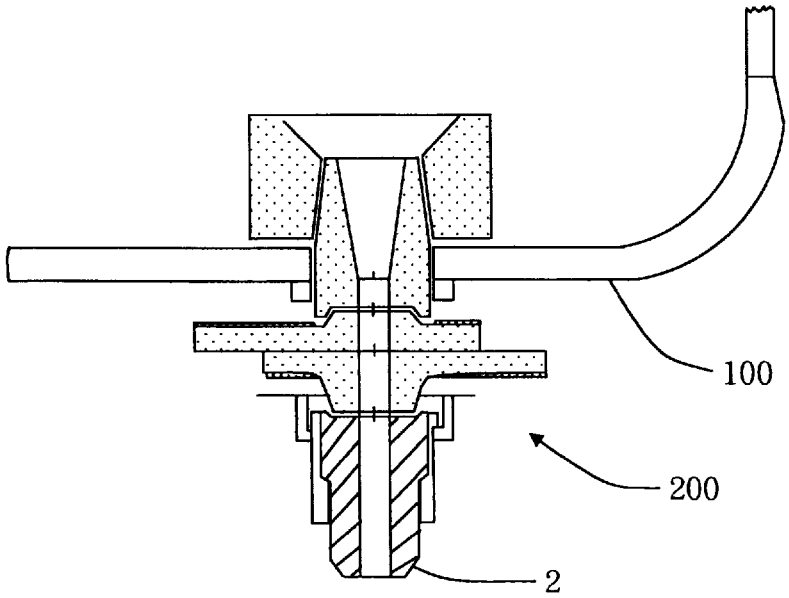
FIG. 5 is a longitudinal cross section showing a conventional collector nozzle connected to a slide gate.

FIG. 4 shows another embodiment. In this embodiment, the first gas passage has slit 32 such as the above-described embodiment shown in FIG. 1, whereas the second gas passage is formed by the porous brick 47. As described above, for the specific configurations of the first and second gas passages, various combinations are possible.

In the above embodiments, in the first and second gas passages, the supplied gas has a pressure of about 1 $kg/cm^2G$ (gauge pressure). However, since the resistances of the gas passages differ, the flow rates of the gases are different as described above. The preferred inert gases are nitrogen (N) gas, argon (Ar) gas, etc. Ar gas is more preferable when the amount of N in steel presents a problem.

EXAMPLE 1

Continuous casting of low carbon aluminum killed steel, (C: 0.05 wt %, Mn: 0.45 wt %, P: not more than 0.01 wt %, S: not more than 0.01 wt %, Al: 0.03–0.06 wt %, N: 0.003–0.006 wt %) which was used for automotive cold rolled steel sheets was carried out many times by continuous-continuous casting (sequence-casting) by using the above-described long nozzle. The results are given in Tables 1 and 2.

Figure 6:
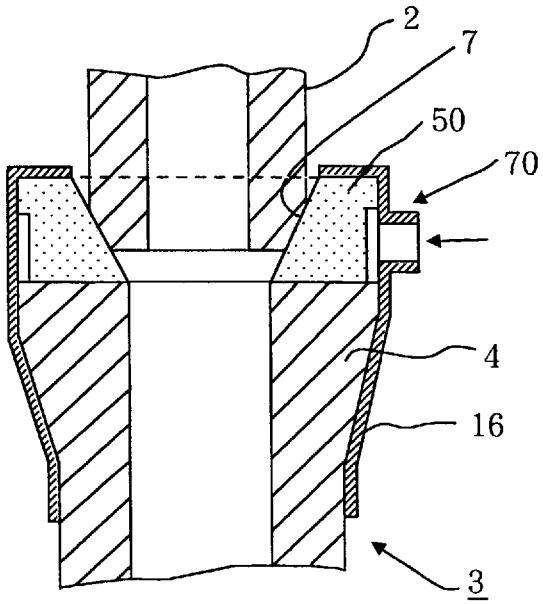
FIG. 6 is a longitudinal cross section of a conventional long nozzle.

Table 1 shows the service life of long nozzles in the case where continuous-continuous casting was performed using either the conventional long nozzle (FIG. 6) or the long nozzle in accordance with the present invention. The service life of the conventional long nozzle was 6 heats on the average, whereas the service life of the long nozzle in accordance with the present invention was 9 heats on the average. Here, the service life is defined as the number of heats in which the fitting between the collector nozzle and the long nozzle is acceptable.

Also, the amounts of atmospheric air absorbed in the casting of the aforementioned low carbon aluminum killed steel were compared by carrying out continuous casting of 20 heats using the conventional long nozzle and the long nozzle in accordance with the present invention. The results are given in Table 2. Table 2 gives the changes in amounts of nitrogen (N) and Al, which are compositions of steel, and the change in amount of oxygen in steel between the ladle and the tundish.

The increased amount of nitrogen, the decreased amount of Al, and the increase in amount of oxygen in steel are proportional to the amount of absorbed air between the ladle and the tundish. The results given in Table 2 show that the use of the long nozzle in accordance with the present invention significantly decreased the absorption of atmospheric air. Needless to say, the increase in amount of nitrogen increases the hardness of steel. Also, the decrease in amount of Al reduces the aging property, and the increase in amount of oxygen in steel deteriorates the cleanliness of steel. Particularly for tinned steel sheets for deep drawing, the highest possible cleanliness of steel is necessary. Therefore, the present invention provides a vital technology for continuous casting of the tinned steel sheets, etc.

TABLE 1

| | Service life of long nozzle in continuous-continuous casting (number of heats) |
|---|---|
| Conventional nozzle | 6 heats on the averaqe |
| Nozzle of this invention | 9 heats on the average |

TABLE 2

| | N = 20 heats | |
|---|---|---|
| Item | Conventional nozzle | Nozzle of this invention |
| Increased amount of nitrogen (ppm) | 8 ± 2 | 1 ± 0.5 |
| Decreased amount of Al (wt %) | 0.007 ± 0.003* | 0.003 ± 0.001* |
| Increased amount of oxygen in steel (ppm) | 10 ± 3* | 5 ± 1* |

(Note)
*: 3 × standard deviation

Average composition of low carbon aluminum killed steel C: 0.05 wt %; Mn: 0.32 wt %; Al: 0.035 wt %; P,S<0.015 wt %

In the conventional long nozzle, argon gas inert gas is blown from one place of the long nozzle. In the present invention, inert gas blowing passages are provided independently at the upper and lower parts of the fitting portion between the ladle collector nozzle and the long nozzle. Thereby, the independent blowing flow rate of inert gas can be set arbitrarily. Therefore, a quite stable sealing property can be kept from the start of continuous casting to the end thereof, despite the roughness produced on the surface of the fitting portion, so that the quality of cast steel can be upgraded significantly.

In the conventional long nozzle, the flow rate of inert gas cannot be regulated in response to the surface roughness of fitting portion. Therefore, when the surface roughness proceeds to some degree, the long nozzle, which is presently being used, must be thrown away. In the present invention, the flow rate of inert gas can be regulated independently at the upper and lower parts of the fitting portion, so that a sufficient sealing effect can be achieved even if the surface roughness of the fitting portion occurs. Therefore, the service life of a long nozzle can be increased.

Although the invention has been described in detail in the foregoing for the purpose of illustration, it is to be understood that such detail is solely for that purpose and that variations can be made therein by those of ordinary skill in the art without departing from the spirit and the scope of the invention as defined by the following claims, including all equivalents thereof.

We claim:

1. A long nozzle for continuous casting, to be fitted to a collector nozzle of a sliding gate attached to the bottom of a ladle, wherein (a) said long nozzle made of a refractory causes molten metal to flow down from said collector nozzle and the head thereof is covered by a metallic shell;

(b) a first gas passage for blowing a first volume of inert gas through a gas blowing means to the vicinity of a fitting portion between said collector nozzle and said long nozzle through a first gas inlet port provided on the side wall of said metallic shell; and (c) a second gas passage for blowing a second volume of inert gas smaller than said first volume through an annular was blowing means into an inner hole of said long nozzle through a second gas inlet port provided on the side wall of said metallic shell.

2. A long nozzle for continuous casting according to claim 1, wherein said first gas passage comprises a gas pool provided between said metallic shell and the side wall of the long nozzle head, which connects to said first gas inlet port, and said gas blowing means comprising a slit provided between said metallic shell and the upper surface of the long nozzle head, which connects to said gas pool.

3. A long nozzle for continuous casting according to claim 1, wherein said first gas passage comprises a gas pool provided between said metallic shell and the side wall of the long nozzle head, which connects to said first gas inlet port, and said gas blowing means comprising a highly permeable porous brick capable of blowing inert gas from said pool to the vicinity of said fitting portion between said long nozzle and said collector nozzle.

4. A long nozzle for continuous casting according to claim 1, wherein said second gas passage comprises a gas passage connected to said second gas inlet port, a gas pool connected to said gas passage, and said annular gas blowing means comprising a gas blowing ring provided with small holes for blowing gas from said gas pool into said inner hole of said long nozzle.

5. A long nozzle for continuous casting according to claim 1, wherein said second gas passage comprises a gas pool provided between said metallic shell and the side wall of the long nozzle head, which connects to said second gas inlet port, and said annular gas blowing means comprising a ring-shaped porous brick for blowing gas from said gas pool into said inner hole of said long nozzle.

6. A long nozzle for continuous casting comprising:

(a) an upper surface of said long nozzle having ahead fitted to a collector nozzle, said collector nozzle having a sliding gate attached to the bottom of a ladle;

(b) said long nozzle further comprising a refractory, which causes molten metal to flow in a direction away from the collector nozzle; said head of said long nozzle being covered by a metallic shell having a side wall;

(c) a first gas passage for blowing a first volume of a first inert gas from a gas inlet port on said wall of said metallic shell through a gas blowing means to a fitting portion between said collector nozzle and said long nozzle; and (d) a second gas passage for blowing a second volume of a second inert gas smaller than said first volume through an annular gas blowing means from an annual inner surface of said long nozzle from a second gas inlet port on said side wall of said metallic shell into an inner hole of said long nozzle.

7. A long nozzle for continuous casting according to claim 6, wherein said first gas passage comprises a gas pool provided between said metallic shell and the side wall of the long nozzle head, which connects to said first gas inlet port, and said gas blowing means comprising a slit provided between said metallic shell and the upper surface of the long nozzle head, which connects to said gas pool.

8. A long nozzle for continuous casting according to claim 6, wherein said first gas passage comprises a gas pool provided between said metallic shell and the side wall of the long nozzle head, which connects to said first gas inlet port, and said gas blowing means comprising a highly permeable porous brick capable of blowing inert gas from said gas pool to the vicinity of said fitting portion between said long nozzle and said collector nozzle.

9. A long nozzle for continuous casting according to claim 6, wherein said second gas passage comprises a gas passage connected to said second gas inlet port, a gas pool connected to said gas passage, and said annular gas blowing means comprising a gas blowing ring provided with small holes for blowing gas from said gas pool into said inner hole of said long nozzle.

10. A long nozzle for continuous casting according to claim 6, wherein said second gas passage comprises a gas pool provided between said metallic shell and the side wall of the long nozzle head, which connects to said second gas inlet port, and said annular gas blowing means comprising a ring-shaped porous brick for blowing gas from said gas pool into said inner hole of said long nozzle.

11. A method of providing inert gas to a long nozzle used for continuous casting, to be fitted to a collector nozzle of a sliding gate attached to the bottom of a ladle wherein said long nozzle is made of a refractory which causes molten metal to flow down from the collector nozzle, and wherein the head thereof is covered by a metallic shell, said method comprising the steps of:

(a) blowing a first volume of a first inert gas into the vicinity of a fitting portion between said collector nozzle and said long nozzle through a first gas inlet port provided on the side wall of said metallic shell; and (b) blowing a second volume of a second inert gas smaller than said first volume through an annular gas blowing means into an inner hole of said long nozzle through a second gas inlet port provided on the side wall of said metallic shell.

12. The method of claim 11 wherein said first inert gas and said second inert gas are the same.

13. The method of claim 11 wherein said first inert gas is argon.

14. The method of claim 11 wherein said second inert gas is argon.

15. The method of claim 11 wherein said first inert gas and said second inert gas is argon.

16. The method of claim 11 wherein said first inert gas is nitrogen.

17. The method of claim 11 wherein said second inert gas is nitrogen.

18. The method of claim 11 wherein said first inert gas and said second inert gas is nitrogen.

* * * * *